US005263870A

United States Patent [19]

Billman et al.

[11] Patent Number: 5,263,870

[45] Date of Patent: Nov. 23, 1993

[54] DUAL READ-OUT SIMM SOCKET FOR HIGH ELECTRICAL SPEED APPLICATIONS

[75] Inventors: Timothy B. Billman, King; Roger L. Thrush, Clemmons, both of N.C.

[73] Assignee: The Whitaker Corporation, Wilmington, Del.

[21] Appl. No.: 991,697

[22] Filed: Dec. 16, 1992

[51] Int. Cl.[5] ..... H01R 13/652

[52] U.S. Cl. ..... 439/108; 439/608; 439/637

[58] Field of Search ..... 439/101, 108, 608, 637

[56] References Cited

U.S. PATENT DOCUMENTS

| | | | |
|---|---|---|---|
| 4,747,787 | 5/1988 | Siwinski | 439/108 |
| 4,762,500 | 8/1988 | Dola et al. | 439/101 |
| 4,850,892 | 7/1989 | Clayton et al. | 439/326 |
| 4,973,270 | 11/1990 | Billman et al. | 439/630 |
| 5,082,459 | 1/1992 | Billman et al. | 439/637 |
| 5,169,324 | 12/1992 | Lemke et al. | 439/108 |
| 5,192,220 | 3/1993 | Billman et al. | 439/637 |

*Primary Examiner*—Gary F. Paumen
*Attorney, Agent, or Firm*—Robert J. Kapalka

[57] ABSTRACT

A dual readout SIMM socket includes a dielectric housing having a module receiving slot, terminal slots transverse and open to the module receiving slot, and terminals positioned in the terminal slots. An electrically conductive ground plane extends along a length of the housing. The ground plane has leads for establishing electrical contact with circuits on a substrate. A plurality of signal and ground terminals are arranged in a selected sequence in the terminal slots. Each of the signal and ground terminals has a trace engaging contact point extending into the module receiving slot for establishing electrical contact with respective signal and ground traces on a SIMM panel received therein. Each of the ground terminals has a contact member for establishing electrical contact with the ground plane. Each of the signal terminals has a lead for establishing electrical contact with other circuits on the substrate.

19 Claims, 6 Drawing Sheets

DUAL READ-OUT SIMM SOCKET FOR HIGH ELECTRICAL SPEED APPLICATIONS

FIELD OF THE INVENTION

This application relates to an electrical connector or socket for use with circuit panels on which single-in-line memory modules (SIMM) are mounted to interconnect circuit thereon to circuits on a substrate.

BACKGROUND OF THE INVENTION

Single in-line memory modules; i.e., "SIMM", represent a high density, low profile single in-line package for electronic components such as dynamic random access memory integrated circuit components. A plurality of these components can be mounted in line on a circuit panel whose height is little more than the length of the components themselves. The circuit panels can in turn be mounted on a printed circuit board daughtercard which can then be mounted on a printed circuit board mothercard. The spacing between adjacent daughtercards would then need to be only slightly greater than the height of the individual circuit panels or single in-line memory modules.

Hereto before circuit panels have been used in which the circuit traces on one side or surface are duplicated and electrically connected to traces on the opposite surface with the traces on both surfaces being in direct alignment with each other. Accordingly the sockets, known as "SIMM" sockets, such as disclosed in U.S. Pat. No. 4,973,270 have terminals which include opposed beams commoned to a single lead to provide redundant electrical engagement to each of the two commoned traces, one on each surface on the panel.

In response to industry's needs, we proposed, as disclosed in U.S. Pat. No. 5,082,459, to electrically isolate circuits and traces on opposite surfaces of the circuit panel so that additional electronic components can be mounted thereon and to provide a SIMM socket having electrically separate terminals on both sides of the panel receiving slot to engage the traces on both surfaces.

We now propose to incorporate an internal electrical ground plane along the length of the socket to further enhance the capabilities of the socket for high speed electrical application. The ground terminals will be spaced interstitially between the signal terminals where the ground terminals will interface with the ground plane then to the printed circuit board and the signal terminals will interface to the printed circuit board.

SUMMARY OF THE INVENTION

According to the present invention, a dual read-out SIMM socket with an internal ground plane is provided for establishing independent electrical circuit traces on opposite sides of a circuit panel for both ground and signal terminals with a longitudinally running metal member for the ground plane. The socket includes a housing having a panel receiving slot and independent terminals on each side of the slot having a contact point extending into the slot for engaging the circuit traces along with the central ground plane for engagement by the ground terminals.

DESCRIPTION OF THE INVENTION

Figure 1:
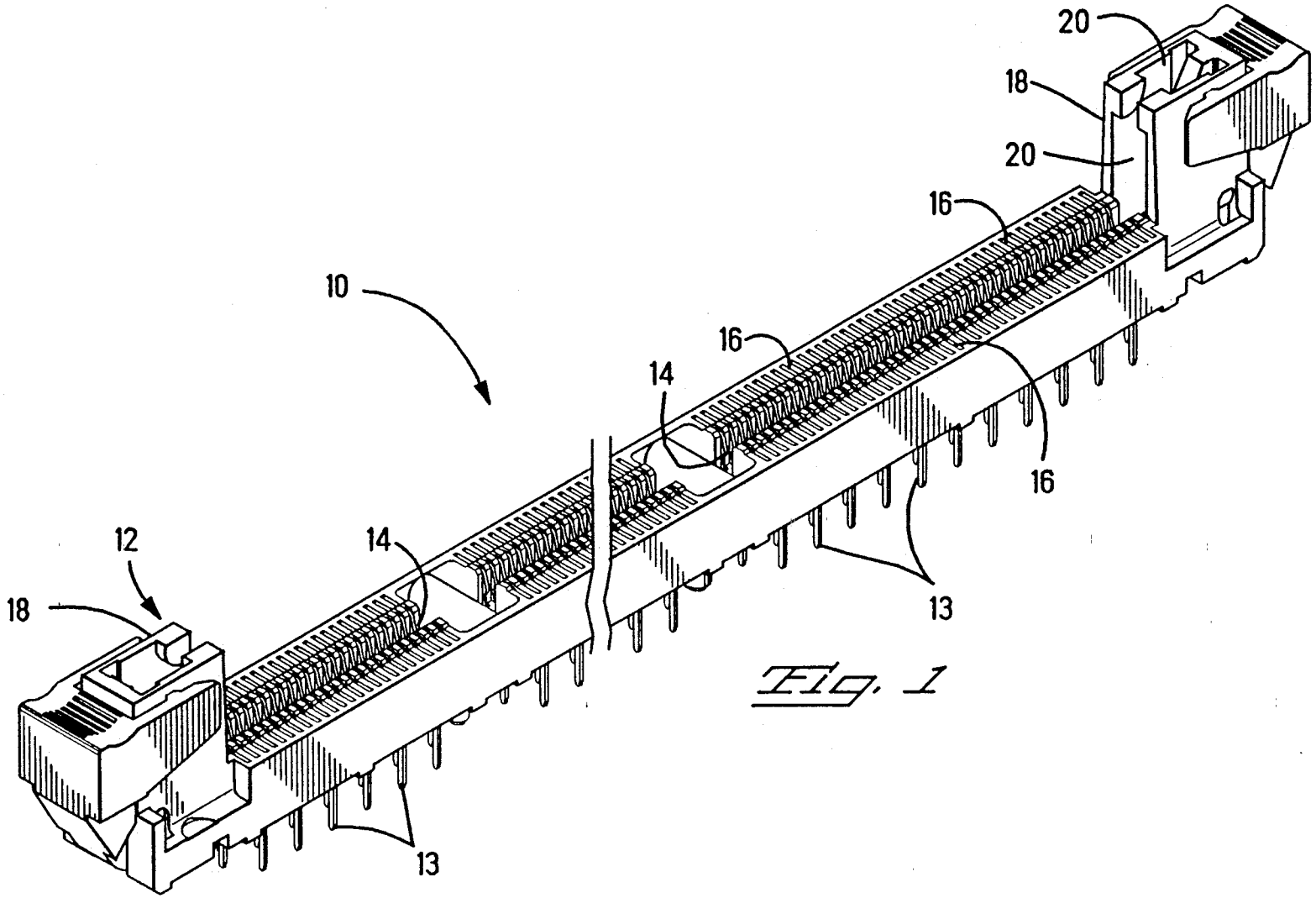
FIG. 1 is a perspective view of the high speed dual read-out SIMM socket of the present invention.
Figure 2B:
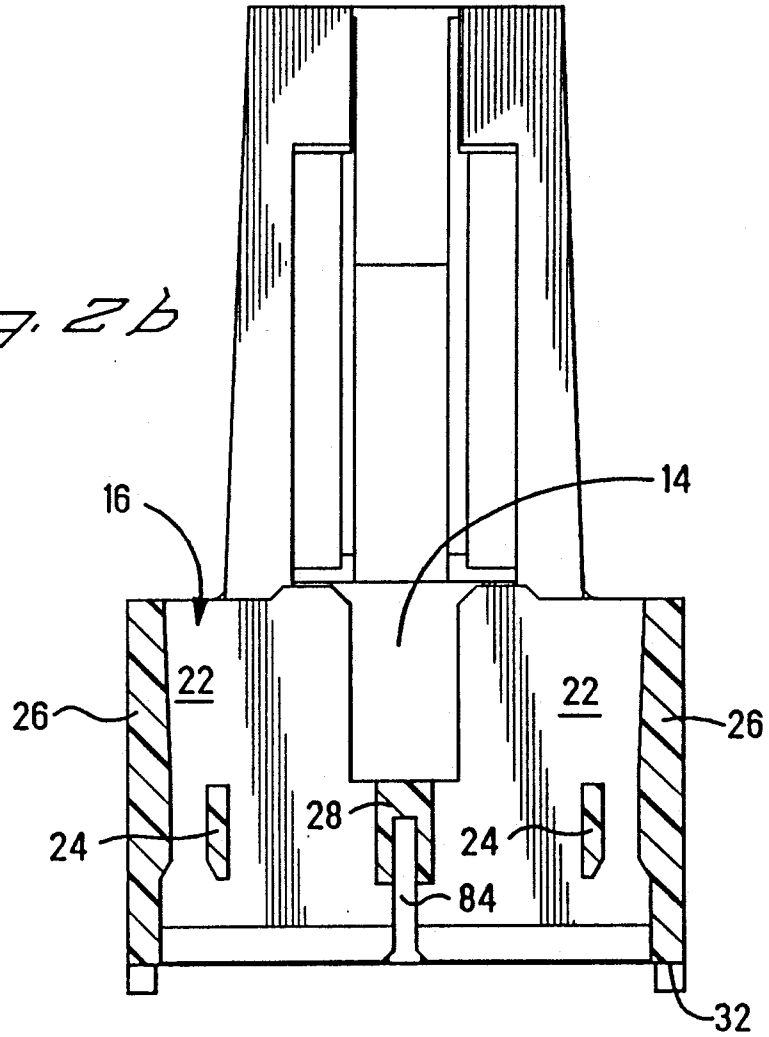
FIG. 2*b* is a sectioned end view of the socket through slots which receive signal terminals.
Figure 2D:
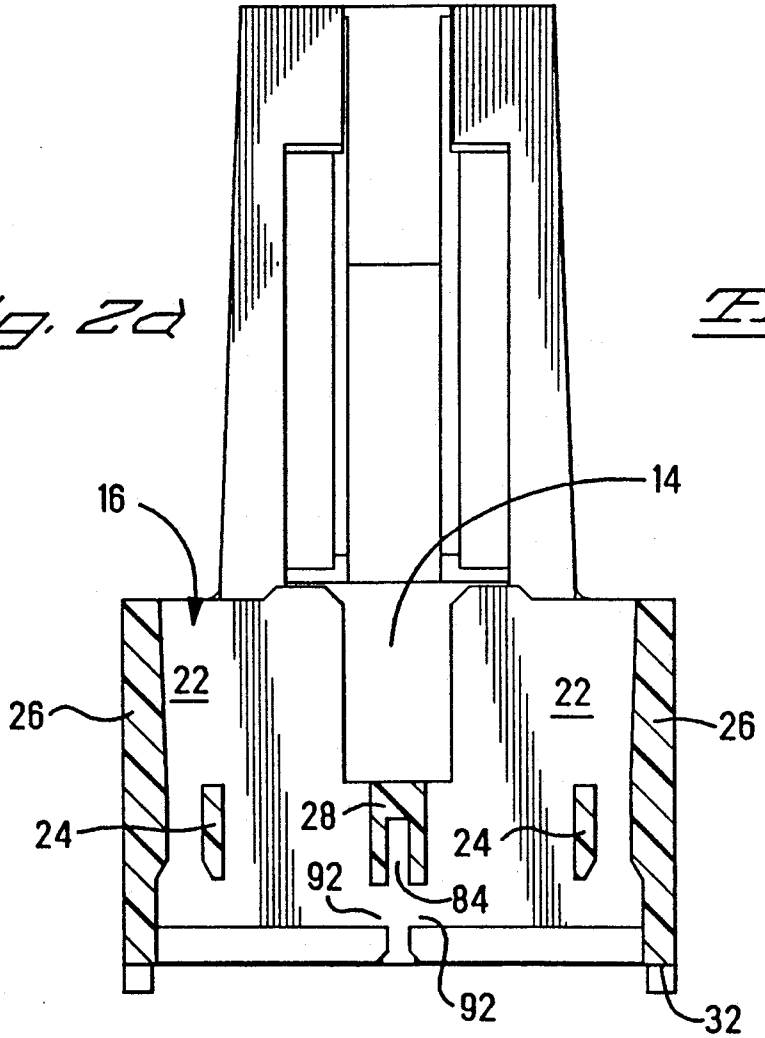
FIG. 2*a* is a sectioned end view of the socket through slots which receive ground terminals.
Figure 4:
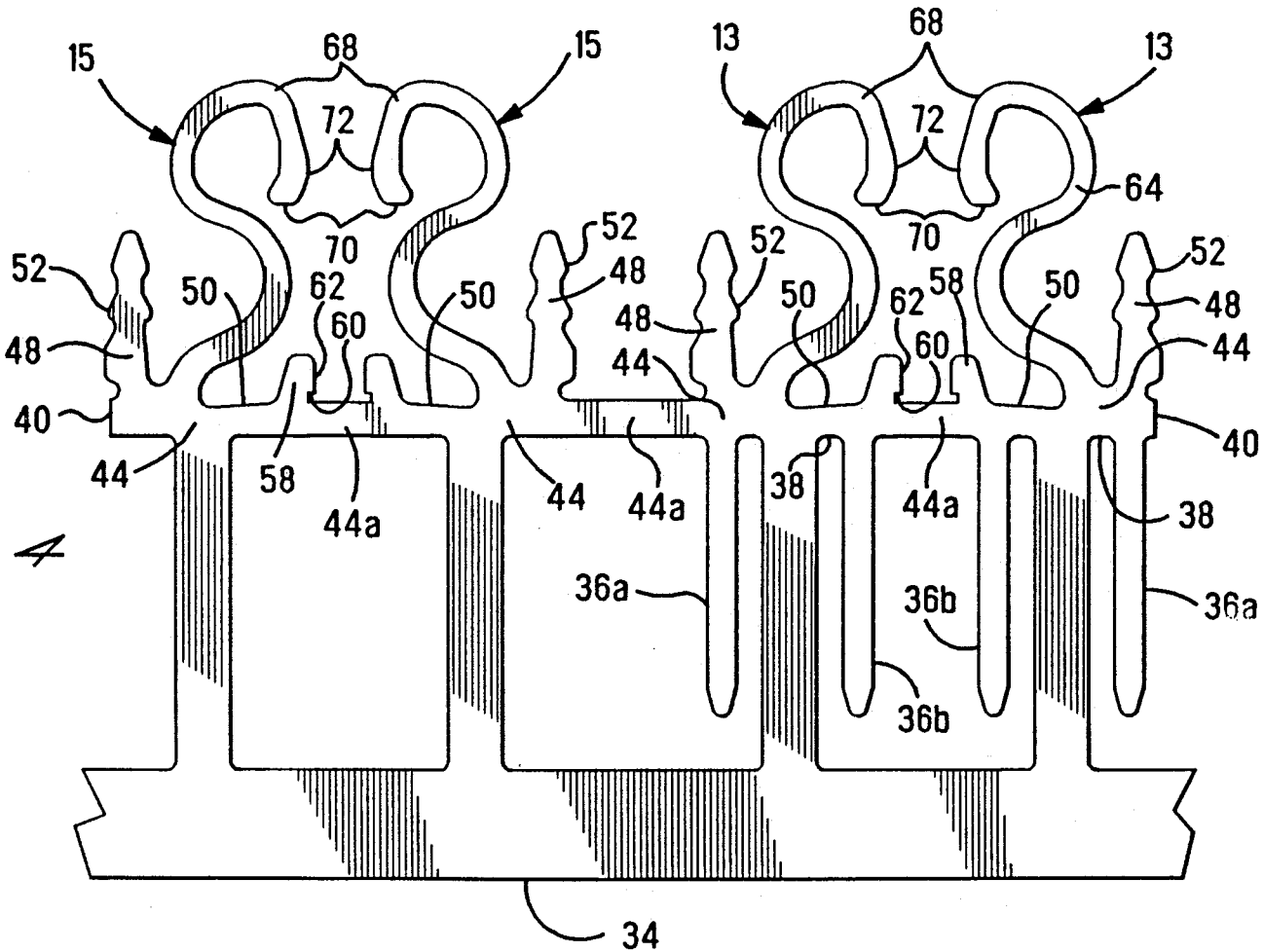
FIG. 4 is a side plan view of the terminals used in the socket.

The dual readout SIMM socket 10 shown in FIG. 1 includes housing 12 and a plurality of terminals 13 and 15 shown in FIGS. 2, 4 and 5.

Housing 12, preferably molded from a suitable plastic material such as a liquid crystal polymer, includes two parallel panel slots 14, a plurality of terminal slots 16 which are normal and open into panel slots 14, and at respective ends, panel support members 18. Grooves 20 in members 18 receive and retain SIMM panels (not shown).

As shown in FIGS. 2*a* and 2*b*, terminal slots 16 are defined by transverse wall 22 which serves to isolate adjacent terminals 13 and 15 and which support retaining bars 24 extending therebetween. Bars 24 are parallel to and spaced in from sidewalls 26 and centerwall 28. Slots 16 are open onto top surface 30 and bottom surface 32 as well as into respective panel slots 14. Slot 84 is open onto bottom surface 32 along a length of the housing 12 as well as into respective slots 16 through openings 92.

Figure 3:
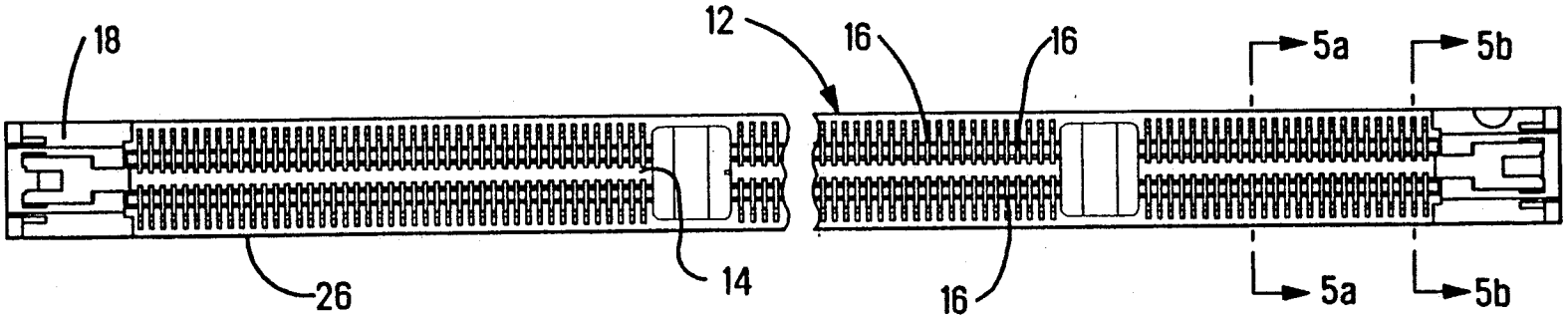
FIG. 3 is a top plan view of the socket.

As shown in FIG. 3, terminal slots 16 face each other on opposite sides of panel slots 14. In the embodiment illustrated, adjacent terminal slots 16 are on a 0.75 mm center line spacing although other spacings; e.g., 0.5 mm, may be used.

FIG. 4 shows one embodiment of terminal 13 on carrier strip 34 with the preferred method of manufacture being by stamping and forming from strips of coplanar stock of phosphor bronze (not shown) other suitable conductive materials may also be used. Each signal terminal 13 includes lead 36*a* or 36*b* attached to and extending away from lower edge 38 and at either end 40 or 42 of base section 44. Each ground plane terminal 15 maintains no lead 36*a* or 36*b*.

First retention post 48 extends away from upper edge 50 at end 40. Post 48 is provided with barbs 52.

Second retention post 58 extends away from upper edge 50 at end 42. Post 58 includes a barb 60 on outside edge 62.

Spring section 64 extends outwardly from its attachment to upper edge 50 and is located just inwardly from first retention post 48. Spring section 64 is S-shaped and carries at free end 66 depending arm 68. The arm 68 at its free end 70 bends slightly back towards section 64 and includes contact point 72 on edge 74.

Figure 5A:
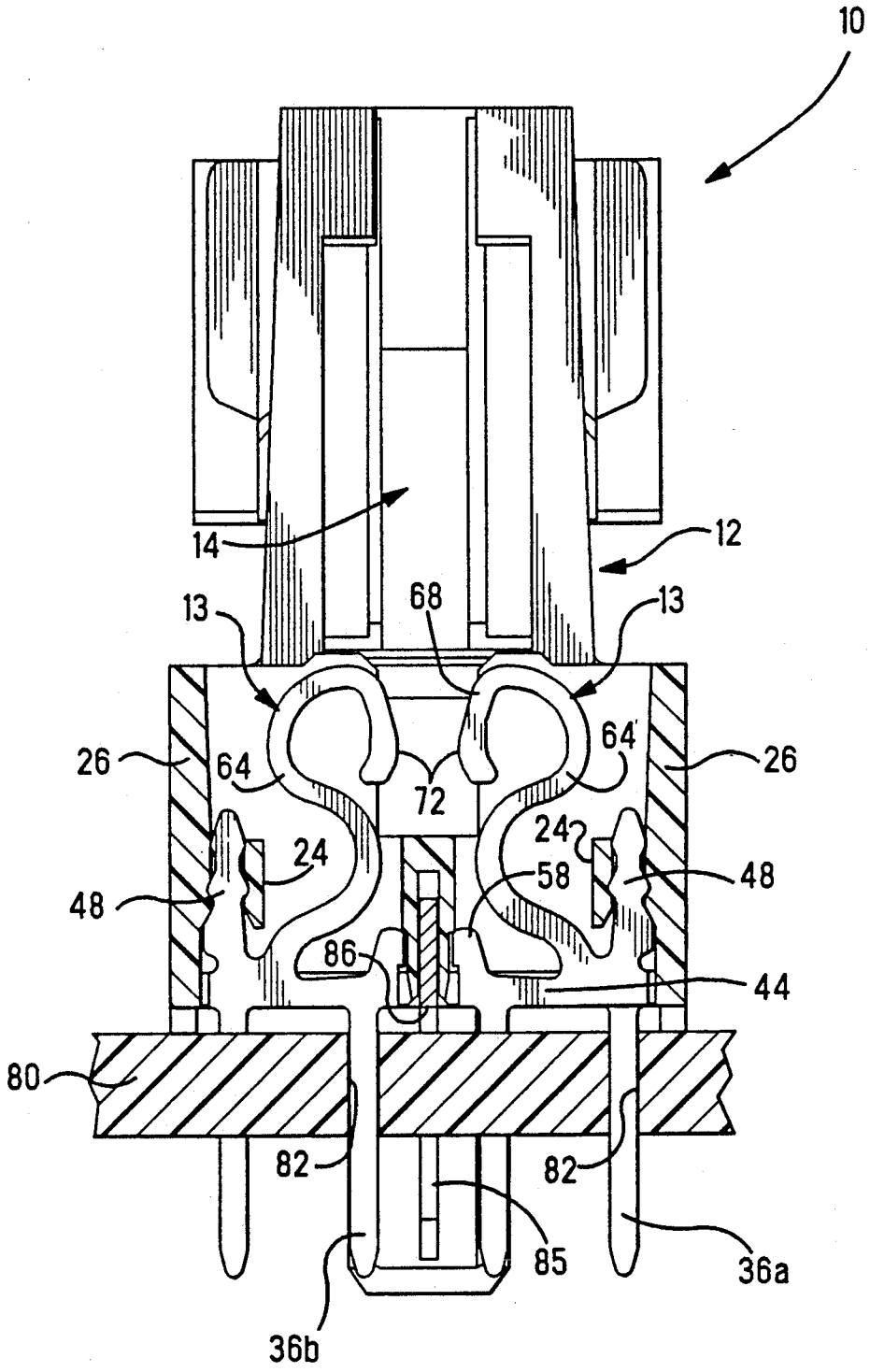
FIG. 5*a* is a sectioned end view of the socket with the signal terminals therein.

As shown in FIG. 5*a*, terminals 13 are retained in slots 16 by first retention post 48 and particularly barbs 52 being frictionally received in the space defined by sidewalls 26 and associated bars 24. Further retention is provided by second retention post 58 being forced against centerwall 28; i.e., the width of slot 16 is slightly less than the length of base section 44. Depending arm 68 extends into panel slot 14 with contact point 72 being most inwardly.

Figure 5B:
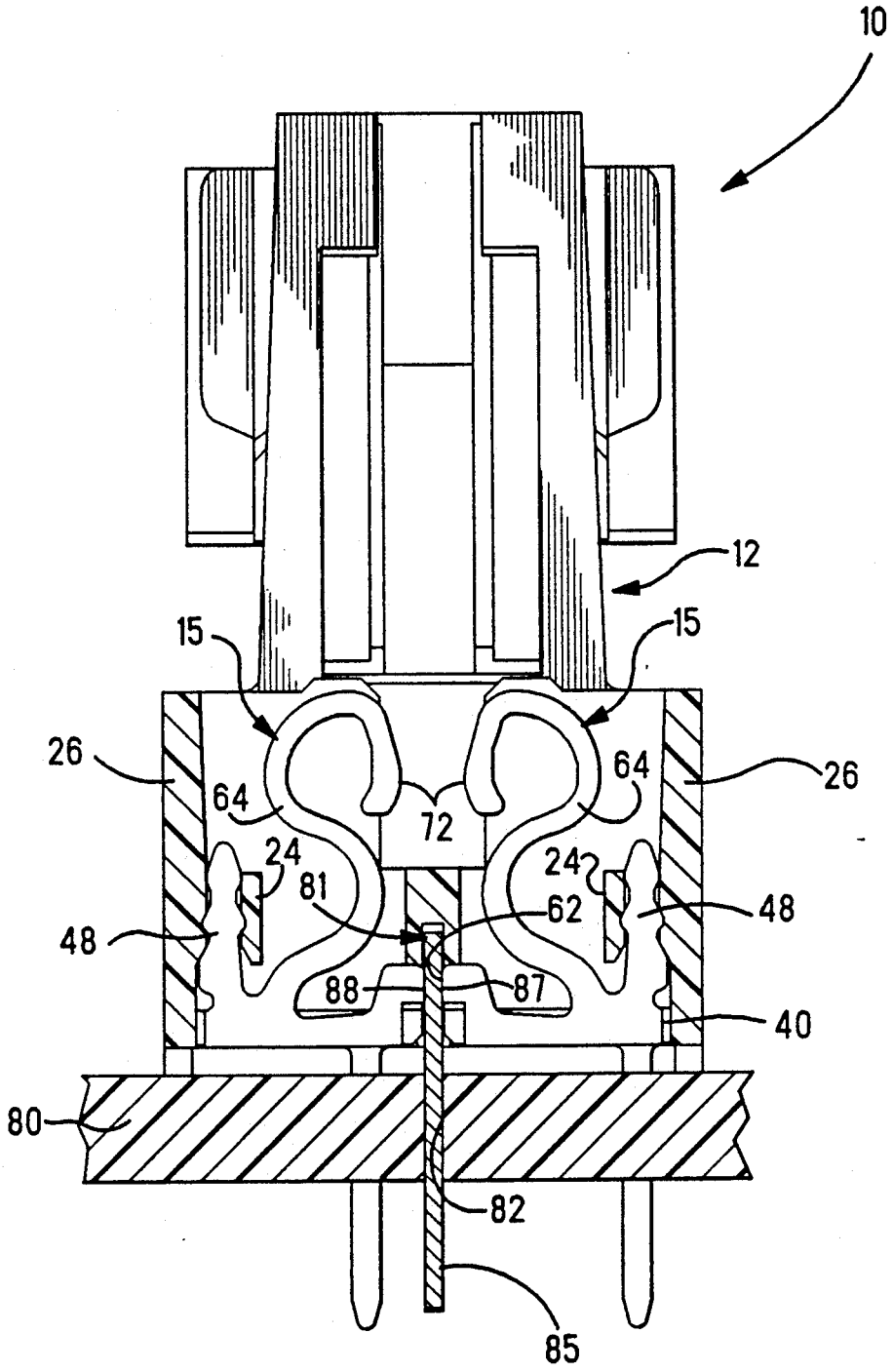

As shown in FIG. 5*b*, terminals 15 are retained in slots 16 in similar manner as terminals 13 except second retention post 58 extends through opening 92 in the center wall 28 so that outside edge 62 contacts the ground plane 81 which is seated in slot 84. The outside edge 62 acts as an electrical contact member to provide an electrical interconnection between the ground plane 81 and the terminal 15.

In a preferred embodiment, pairs of the terminals 13 and 15 are disposed alternately along the entire length of the housing 12. However, the terminals 13 and 15 may be disposed in any selected arrangement necessary for mating with appropriate signal and ground traces on a SIMM panel.

FIGS. 5*a* and 5*b* also illustrate socket 10 mounted on substrate 80 which may be a back plane, printed circuit board or other like device. During loading, a pair of terminals 13 and 15 as shown in FIG. 4 are partially inserted into slots 16 from below and carrier strip 34 is severed therefrom. Further, the continuation of base section 44 which extends between paired terminals 13 and 15, indicated by reference numeral 44*a* in FIG. 4, is cut away to separate the terminals 13 and 15. As can be seen from the drawing, terminals 13 in adjacent slots 16 will have either lead 36*a* or 36*b*. Terminals 13 in slots 16 across panel slot 14 will have an opposite lead 36*a*, 36*b*. Thus, as shown, the left-hand terminal 13 has lead 36*a* depending therefrom while the right-hand terminal 13 has lead 36*b* depending therefrom. Leads 36 are inserted and soldered in holes 82 in substrate 80 in a manner well known in the industry. In lieu of leads 36, terminals 13 may have surface mount leads (not shown) or other means for establishing electrical contact with the substrate.

Figure 6B:
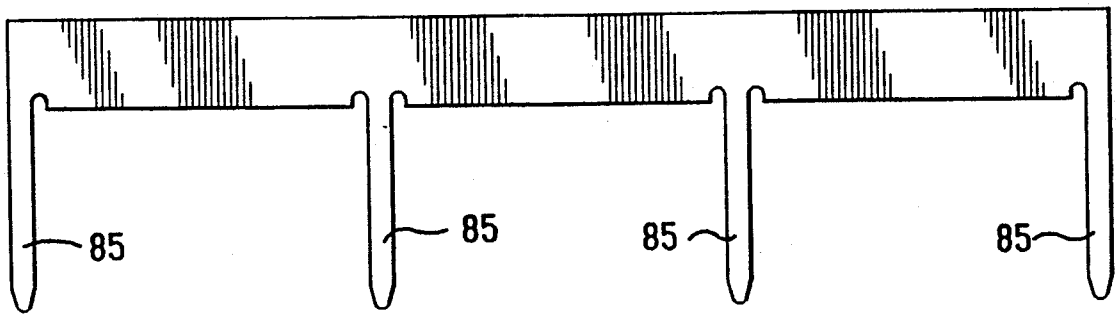
FIG. 6*b* is an alternate embodiment of a ground plane used in the socket.
Figure 6A:
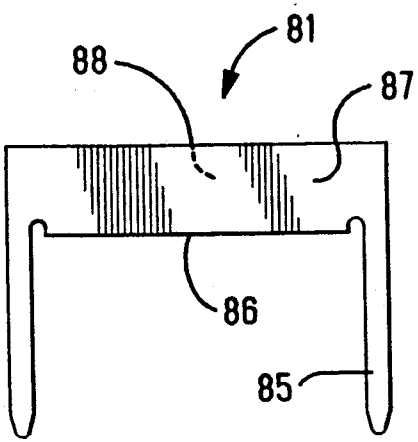
FIG. 5*b* is a sectioned end view of the socket with the round terminals therein and FIG. 6*a* is a side plan view of a ground plane used in the socket.

FIG. 6*a* shows one embodiment of ground plane 81 with leads 85 attached to and extending away from edge 86. Ground plane 81, which is made from any suitable electrically conductive material, is inserted into slot 84 and retained by an interference fit between ground plane 81 and centerwall 28. FIG. 6*b* is an alternate embodiment of the round plane 81 having four of the leads 85 spaced along its length.

In the preferred embodiment, every other terminal slot 16 has opening 92 extending through the center wall 28 to the ground plane 81. The openings 92 receive the contact members 62 therethrough to enable an electrical interconnection between the terminals 15 and the ground plane faces 87, 88.

Leads 85 of the ground plane 81 are inserted and soldered in holes 82 in substrate 80 in a manner well known in the industry. In use, signal and ground traces on opposite sides of a circuit panel (not shown) received in panel slot 14 engage opposite and electrically isolated contact points 72 and are electrically interconnected to circuits (not shown) on substrate 80.

Socket 10 has been illustrated as having one panel slot 14. Obviously, socket 10 could be modified to include two, or more, parallel panel slots 14.

The ability to stagger leads 36 and inline leads 85 reflects the hole pattern on substrate 80. Obviously other patterns may require other staggered arrangements than shown.

As can be discerned, a highspeed dual readout SIMM socket has been disclosed. The socket includes one or more panel slots and transverse thereto a plurality of terminal slots. The terminals positioned in the slots include a S-shaped spring section from which an arm having a contact point depends. Retention members, one at each end of a base section, retain the terminal in the slot with leads extending outwardly from the housing for insertion into holes in the substrate. The contact points on the depending arms extend into the panel slot to resiliently and electrically engage conductive traces on opposite surfaces of a panel inserted into the panel slot. An electrically conductive ground plane is disposed in the socket to enable selective connection of signal and ground terminals to respective signal and ground traces on a SIMM panel.

We claim:

1. A high speed dual readout SIMM socket for establishing electrical contact with electrical isolated signal and round circuit traces on no more than 0.75 mm centerline spacing on opposite surfaces of a single in-line memory module, said socket comprising:

a housing having a module receiving slot extending between and into module retaining grooves at each end of said housing and terminal receiving slots normal to and intersecting said module receiving slot on both sides thereof and a ground plane receiving slot extending longitudinally down the length of said housing;

a plurality of signal and ground terminals disposed in said terminal receiving slots and having a S-shaped spring section with a trace engaging contact point on a depending arm extending into said module receiving slot, a base section having an upper edge from which said spring section extends, a lower edge from which a lead extends, a retaining post at one end extending outwardly parallel and adjacent to a side wall and having retaining barbs thereon for engaging said side wall and a stabilizing post at another end which extends obliquely outwardly therefrom for engaging a center rib or ground plane of said housing; and a ground plane located centrally to the housing body and disposed between said terminals, press fit into the receiving slot so that the stabilizing post from the ground terminals will engage engage said ground plane, thus forming an electrical connection.

2. The socket of claim 1 wherein said terminals are edge stamped.

3. The socket in claim 1 wherein said housing has a central receiving slot extending the entire length of the socket.

4. The socket in claim 1 wherein said ground plane runs the entire length of said housing.

5. The socket in claim 1 where said housing includes a panel support member on each end thereof with said module-returning grooves therein.

6. The socket in claim 1 wherein said terminals are leaded for signal and leadless for ground.

7. The socket in claim 1 wherein said can be sectioned into various sizes.

8. The terminal in claim 1 wherein said stabilizing posts extending from the ground terminals engages the ground plane for electrical connection.

9. The terminal in claim 6 wherein said leadless ground terminals can be leaded for special electrical applications.

10. A dual readout SIMM socket for establishing electrical contact with electrically isolate signal and ground circuit traces on opposite surfaces of a single in line memory module, said socket comprising:

a dielectric housing having a module receiving slot opening upwardly and extending between and into module retaining grooves at opposite ends of the hosing, and terminal receiving slots normal to and intersecting said module receiving slot on both sides thereof;

an electrically conductive ground plane disposed in said housing and extending along a length f said housing, said ground plane having leads for establishing electrical contact with circuits on a substrate; and, a plurality of signal and ground terminals disposed in a selected sequence in said terminal receiving slots, each of said signal and ground terminals having a trace engaging contact point extending into said module receiving slot for establishing electrical contact with respective signal and ground circuit traces on a said module which may be received therein, each of said ground terminals having a contact member for establishing electrical contact with the ground plane, each of said signal terminals having a lead for establishing electrical contact with other circuits on the substrate.

11. The socket according to claim 10, wherein said ground plane is disposed beneath said module receiving slot.

12. The socket according to claim 10, wherein said ground plane is disposed in a center wall of said housing beneath said module receiving slot, said center wall defining openings communicating between said ground plane and said terminal receiving slots having said ground terminals, said contact members of said ground terminals extending through said openings and electrically connecting with said ground plane.

13. The socket according to claim 12, wherein said center wall defines a ground plane receiving lot which is open downwardly, and said ground plane is disposed in said ground plane receiving slot.

14. The socket according to claim 13, wherein said ground plane is retained in said ground plane receiving slot by an interference fit.

15. The socket according to claim 10, wherein said plurality of signal and ground terminals are disposed in alternating sequence in said terminal receiving slots.

16. The socket according to claim 12, wherein each of said signal and ground terminals has a bas section having an upper edge and a lower edge, an S-shaped spring section extends from the upper edge an has a depending arm with the trace engaging contact point thereon, and the lead of each of the signal terminals extends from the lower edge.

17. The socket according to claim 16, wherein said base section includes a first retention post at one end extending outwardly parallel and adjacent to a side wall of the housing and having retaining barbs thereon for engaging the side wall.

18. The socket according to claim 17, wherein said base section includes a second retention post extending from an other end for engaging the center wall of the housing, and the contact member of the ground terminals is disposed on the second retention post.

19. The socket according to claim 16, wherein the spring section decreases in width from said base section for providing stress relief on the spring section when engaging a said module.

* * * * *

UNITED STATES PATENT AND TRADEMARK OFFICE

CERTIFICATE OF CORRECTION

PATENT NO. : 5,263,870

DATED : November 23, 1993

INVENTOR(S) : Timothy B. Billman et al

It is certified that error appears in the above-indentified patent and that said Letters Patent is hereby corrected as shown below:

Column 4, line 59, insert --ground plane-- after the word "said"

Column 4, line 62, "engages" should be --engage--.

Column 4, line 68, "isolate" should be --isolated--.

Column 5, line 6, "hosing" should be --housing--.
line 12, "f" should be --of--.

Column 6, line 4, "lot" should be --slot--.

Column 6, lines 14 and 16, "bas" should be --base--. "an" should be --and--.

Signed and Sealed this

Twelfth Day of July, 1994

Bruce Lehman

*Attest:*

BRUCE LEHMAN

*Attesting Officer*

*Commissioner of Patents and Trademarks*